US007100798B2

(12) United States Patent
Spivey

(10) Patent No.: US 7,100,798 B2
(45) Date of Patent: Sep. 5, 2006

(54) CARTON WITH AN IMPROVED DISPENSING FEATURE

(75) Inventor: Raymond Rudolph Spivey, Mableton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 590 days.

(21) Appl. No.: 10/777,614

(22) Filed: Feb. 12, 2004

(65) Prior Publication Data

US 2004/0159671 A1 Aug. 19, 2004

Related U.S. Application Data

(63) Continuation of application No. 10/425,846, filed on Apr. 29, 2003, now Pat. No. 6,715,639, which is a continuation of application No. 09/757,714, filed on Jan. 9, 2001, now Pat. No. 6,578,736.

(51) Int. Cl.
*A47F 1/04* (2006.01)

(52) U.S. Cl. ..... 221/305; 229/122.1

(58) Field of Classification Search ..... 221/305, 221/303, 33, 256; 229/221, 122.1; 206/427, 206/193, 141

See application file for complete search history.

(56) References Cited

U.S. PATENT DOCUMENTS

| | | | | |
|---|---|---|---|---|
| 902,347 | A | 10/1908 | Tillinghast | |
| 1,541,143 | A | 6/1925 | Hoile | 229/231 |
| 1,925,102 | A | 9/1933 | Levkoff | 206/44 |
| 2,124,808 | A | 7/1938 | White et al. | |
| 2,448,819 | A | 9/1948 | Mitchell | |
| 2,718,301 | A | 9/1955 | Palmer | 206/65 |
| 2,723,027 | A | 11/1955 | Guyer | 206/65 |
| 2,754,047 | A | 7/1956 | Schmidt et al. | 229/51 |
| 2,842,304 | A | 7/1958 | Ringler | 229/51 |
| 2,868,431 | A | 1/1959 | Painter | 229/51 |
| 2,919,844 | A | 1/1960 | Anderson, Jr. | |
| 2,930,516 | A | 3/1960 | Fowle et al. | 229/7 |
| 2,975,891 | A | 3/1961 | Stone | 206/65 |
| 2,990,097 | A | 6/1961 | Thompson | 229/20 |
| 3,002,651 | A | 10/1961 | Gauld | 221/34 |
| 3,018,031 | A | 1/1962 | Ahlbor et al. | 229/44 |
| 3,178,242 | A | 4/1965 | Ellis et al. | 312/45 |
| 3,228,582 | A | 1/1966 | Osberg | 229/51 |
| 3,263,861 | A | 8/1966 | Carr | 221/302 |
| 3,265,283 | A | 8/1966 | Farquhar | 229/27 |
| RE26,083 | E | 9/1966 | Forrer | 220/115 |
| 3,300,115 | A | 1/1967 | Schauer | 229/27 |
| 3,332,594 | A | 7/1967 | Capua | 224/15 |
| 3,356,279 | A | 12/1967 | Root | 229/17 |

(Continued)

FOREIGN PATENT DOCUMENTS

| | | |
|---|---|---|
| DE | 2 323 589 A | 5/1973 |
| DE | 7510538 | 8/1975 |

(Continued)

OTHER PUBLICATIONS

"Dispensing Multipack, Coke Canner Rolls Out 'Fridge-Friendly' Pack, " Packaging World, Sep. 2001, p. 2, [Summit Publishing Company—Chicago].

(Continued)

*Primary Examiner*—Kenneth Noland
(74) *Attorney, Agent, or Firm*—Womble Carlyle Sandridge & Rice, PLLC

(57) ABSTRACT

A carton with an improved dispenser at one of the carton which preserves the integrity of the carton when the carton is opened by permitting a bottom end flap attached to the bottom panel to remain in place and also a portion of each side end flap that is adjacent to the bottom end flap. This dispenser may also provide a safety net for the first container that is automatically dispensed when the carton is opened.

90 Claims, 4 Drawing Sheets

U.S. PATENT DOCUMENTS

| | | | | |
|---|---|---|---|---|
| 3,517,858 | A | 6/1970 | Farquhar | 221/305 |
| 3,540,581 | A | 11/1970 | Koolnis | 206/193 |
| 3,599,858 | A | 8/1971 | Samsing | 229/51 |
| 3,669,251 | A | 6/1972 | Phillips | 206/44 |
| 3,765,327 | A | 10/1973 | Vargo | 101/232 |
| 3,765,527 | A | 10/1973 | Vargo | 206/44 |
| 3,894,681 | A | 7/1975 | Arneson et al. | 221/305 |
| 3,913,739 | A | 10/1975 | Hennessey | 206/434 |
| 3,942,631 | A | 3/1976 | Sutherland et al. | 206/44.12 |
| 4,000,811 | A | 1/1977 | Hardinson et al. | 229/242 |
| D243,508 | S | 3/1977 | Killy | D9/245 |
| 4,030,596 | A | 6/1977 | Snyder et al. | 206/45.26 |
| D252,259 | S | 7/1979 | Rinehart | D9/245 |
| 4,214,660 | A | 7/1980 | Hunt, Jr. | 206/427 |
| 4,216,861 | A | 8/1980 | Oliff | |
| 4,222,485 | A | 9/1980 | Focke | 206/141 |
| D263,204 | S | 3/1982 | Dutcher | D9/433 |
| 4,325,482 | A | 4/1982 | Feeser | 206/625 |
| 4,364,509 | A | 12/1982 | Holley, Jr. et al. | 229/95 |
| 4,375,258 | A | 3/1983 | Crayne et al. | 432/141 |
| D269,068 | S | 5/1983 | Mann et al. | D9/416 |
| D270,041 | S | 8/1983 | Vestal | D9/416 |
| 4,396,143 | A | 8/1983 | Killy | 221/305 |
| 4,416,410 | A | 11/1983 | Herrmann | 229/38 |
| 4,417,661 | A | 11/1983 | Roccaforte | 229/232 |
| 4,465,180 | A | 8/1984 | Klygis | |
| 4,498,581 | A | 2/1985 | Dutcher | 206/427 |
| 4,582,199 | A | 4/1986 | Schuster | 206/428 |
| D286,987 | S | 12/1986 | Golan et al. | D9/433 |
| 4,726,471 | A | 2/1988 | Whately et al. | 206/554 |
| 4,756,419 | A | 7/1988 | Le Bras | |
| 4,785,991 | A | 11/1988 | Schuster | 229/52 |
| D303,090 | S | 8/1989 | Armor et al. | D9/433 |
| 4,860,944 | A | 8/1989 | Wonnacott | 229/52 |
| 4,919,266 | A | 4/1990 | McIntosh, Jr. et al. | 206/434 |
| 4,966,324 | A | 10/1990 | Steel | 229/117.13 |
| 4,972,991 | A | 11/1990 | Schuster | 229/117.13 |
| 4,974,771 | A | 12/1990 | Lavery | 229/117.13 |
| 4,981,253 | A | 1/1991 | Quaintenance | 229/117.13 |
| 5,002,186 | A | 3/1991 | Cooper | 206/433 |
| 5,031,825 | A | 7/1991 | Romagnoli | 229/160.1 |
| 5,067,615 | A | 11/1991 | Davitian | 229/230 |
| 5,101,642 | A | 4/1992 | Alexandrov | 62/371 |
| 5,123,589 | A | 6/1992 | Cote | 229/232 |
| 5,137,211 | A | 8/1992 | Summer et al. | 229/164 |
| 5,170,934 | A | 12/1992 | Lemoine | 229/101 |
| D332,915 | S | 2/1993 | Hoell et al. | D9/346 |
| 5,277,360 | A | 1/1994 | DeMott | 229/122 |
| 5,279,440 | A | 1/1994 | Fougeres et al. | 220/228 |
| 5,284,292 | A | 2/1994 | Johnson | 229/122.1 |
| 5,333,734 | A | 8/1994 | Stout et al. | |
| 5,368,194 | A | 11/1994 | Oliff et al. | 221/305 |
| 5,427,242 | A | 6/1995 | Oliff et al. | 206/430 |
| 5,465,831 | A | 11/1995 | Smith | 206/44 |
| 5,505,372 | A | 4/1996 | Edson | 229/121 |
| 5,518,111 | A | 5/1996 | Stout | 206/160 |
| 5,622,309 | A | 4/1997 | Matsuda et al. | 229/243 |
| 5,722,584 | A | 3/1998 | Fujiwara | 229/120.15 |
| 5,775,574 | A | 7/1998 | Whitnell | 229/120.18 |
| 5,826,783 | A | 10/1998 | Stout | 229/120.32 |
| 5,833,118 | A | 11/1998 | Weiss | 221/309 |
| 5,873,515 | A | 2/1999 | Dunn et al. | 229/117.13 |
| 5,878,947 | A | 3/1999 | Hoy et al. | 229/122.1 |
| 5,881,884 | A | 3/1999 | Podosek | 206/774 |
| 6,105,854 | A | 8/2000 | Spivey | 229/122.1 |
| D436,859 | S | 1/2001 | Botsford et al. | D9/416 |
| 6,176,419 | B1 | 1/2001 | Holley, Jr. | 229/122.1 |
| 6,283,293 | B1 | 9/2001 | Lingamfelter | 206/427 |
| D454,784 | S | 3/2002 | Oram | D9/416 |
| 6,386,369 | B1 | 5/2002 | Yuhas et al. | 206/746 |
| 6,435,351 | B1 | 8/2002 | Gibb | 206/736 |
| 6,478,219 | B1 | 11/2002 | Holley, Jr. | 229/240 |
| 6,550,615 | B1 | 4/2003 | Linghamfelter | 206/427 |
| 6,578,736 | B1 | 6/2003 | Spivey | |
| 6,631,803 | B1 | 10/2003 | Rhodes et al. | 206/427 |
| 2002/0070139 | A1 | 6/2002 | Bates | |
| 2002/0088820 | A1 | 7/2002 | Spivey | |
| 2002/0185527 | A1 | 12/2002 | Bates | |
| 2003/0141353 | A1 | 7/2003 | Wilson | 229/103.2 |

FOREIGN PATENT DOCUMENTS

| | | |
|---|---|---|
| DE | 76 06 493 U1 | 6/1976 |
| DE | 29 33 022 C2 | 8/1979 |
| DE | 30 07 769 C2 | 2/1980 |
| DE | 81 35 176 U1 | 11/1981 |
| DE | G 8514718.4 | 8/1985 |
| DE | G 8629664.7 | 11/1986 |
| DE | 3612594 A1 | 10/1987 |
| DE | 40 23 043 A1 | 7/1990 |
| DE | 94 12 885 U1 | 8/1994 |
| DE | 94 13 813 U1 | 8/1994 |
| DE | 694 21 620 T2 | 8/1994 |
| DE | 295 19 931 U1 | 12/1995 |
| DE | 296 02 010 U1 | 2/1996 |
| DE | 299 09 008 U1 | 5/1999 |
| DE | 29913585 U1 | 8/1999 |
| EP | 235 852 B1 | 2/1987 |
| EP | 0323596 A1 | 12/1988 |
| EP | 342 088 B1 | 4/1989 |
| EP | 0475147 A1 | 8/1991 |
| EP | 659 143 B1 | 6/1994 |
| EP | 752 370 A2 | 7/1995 |
| EP | 936 995 B1 | 11/1997 |
| EP | 0849189 A1 | 6/1998 |
| EP | 1 060 998 A2 | 6/2000 |
| WO | WO 88/09750 | 6/1988 |
| WO | WO 95/25668 | 3/1994 |
| WO | WO 96/29260 | 9/1996 |
| WO | WO 97/21607 | 6/1997 |
| WO | WO 98/31593 | 12/1997 |
| WO | WO 99/64301 | 6/1998 |
| WO | WO 00/23334 | 10/1999 |
| WO | WO 00/71428 A1 | 5/2000 |
| WO | WO 02/04302 A1 | 7/2000 |
| WO | WO 01/28871 A1 | 10/2000 |
| WO | WO 02/085739 A1 | 4/2001 |

OTHER PUBLICATIONS

"Hot Hit With Consumers," International Bottler & Packer, Nov. 2001 [Binstead Publications Ltd.].

"Coke Bottler Tests A Slimmer Soda Package", Wall Street Journal B3 (Aug. 10, 2001).

"Passing the Torch", BeverageWorld p. 36 (Oct. 2002).

"RIVERWOOD" For the Carton Designated as 'Fridge Pack,' International Bottler & Packer, Nov. 2001 [Binstead Publications Limited—United Kingdom].

"Coca–Cola Fridge Mate", p. 3 Revise Woolworth's Advertisement wca4000 / N I A.

"*Riverwood International Corporation* v. *MeadWestvaco Corporation*" Civ. Action No. 1:03CV1672 (Jun. 17, 2003 N.D. Ga.) Plaintiff's [Riverwood] Motion for Prelim. Injunction.

"*Riverwood International Corporation* v. *MeadWestvaco Corporation*" Civ. Action No. 1:03CV1672 (N.D. Ga.) Defendant's [MeadWestvaco] Memorandum In Opposition to Plaintiff's [Riverwood] Motion for a Preliminary Injunction.

"*Riverwood International Corporation* v. *MeadWestvaco Corporation*" Civ. Action No. 1:03CV1672 (N.D. Ga.) Plaintiff's [Riverwood] Reply to Defendant's [MeadWestvaco] Memorandum In Opposition to Plaintiff's [Riverwood] Motion for a Preliminary Injunction.

"*Riverwood International Corporation* v. *Meadwestvaco Corporation*," Civ. Action No. 1:03–CV—1672 (TWT) (N.D. Ga.), Riverwood's Supplemental Pre–Hearing Brief in Support of Plaintiff's [Riverwood] Motion for Preliminary Injunction.

"*Riverwood International Corporation* v. *Meadwestvaco Corporation*," Civ. Action No. 1:03–CV—1672 (TWT) (N.D. Ga.), Meadwestvaco's Supplemental Memorandum in Opposition to Riverwood's Motion for a Preliminary Injunction.

CARTON WITH AN IMPROVED DISPENSING FEATURE

This application is a continuation of Ser. No. 10/425,846, filed on Apr. 29, 2003 now U.S. Pat. No. 6,715,639, which is a continuation of Ser. No. 09/757,714, filed on Jan. 9, 2001 now U.S. Pat. No. 6,578,736.

BACKGROUND OF THE INVENTION

1. Field of the Invention

The present invention relates generally to an enclosed paperboard carton capable of enclosing containers, which carton has a unique opening and dispensing feature that allows the containers, for example, cans or bottles, to be removed or dispensed without destroying the overall structural integrity of the carton. The dispensing feature may also provide a safety net for the first container that is automatically dispensed when the carton is opened. This dispensing feature also permits the carton to be carried from one location to another after the dispenser has been opened without the containers falling out of the carton.

2. Background

Fully enclosed carton capable of enclosing cans have been used in the past that have a feature for dispensing the cans one at a time. Dispenser sections have been provided at various locations within these cartons depending on the design. Many of these dispensers suffer from the disadvantage that once open, they allow all of the containers to roll out. In addition, it is difficult to carry one of these cartons without the containers falling out once the dispenser has been opened. Most of these dispensers have been designed for dispensing cans or bottles which have cylindrical tops and bottoms of substantially the same size and configuration. These dispensers are not suitable for dispensing bottles that have a neck of smaller diameter than the body of the bottle.

In effect, many of these dispensers destroy the overall carton integrity once they have been opened. Many of these dispensing features do not have any means for preventing the first container that is automatically dispensed from falling free from the carton. In other words, its dispensing feature has no safety net.

3. Prior Art

U.S. Pat. No. 3,265,283 to Farquhar discloses a fully enclosed carton having a dispenser for dispensing the enclosed cans. The end wall of the carton has a dispensing flap which can be folded down upon opening. An aperture formed by the flap extends into the side walls to permit grasping of the can to withdraw it from the carton. When the flap is opened, the cans are held in the carton by an accurate flap portion extending downwardly in the end wall into the center of the aperture. The structural integrity of this carton is compromised because the entire bottom end of the carton is opened. The dispensing flap does not provide a safety net to prevent a can from rolling out of the carton and falling to the floor. This carton cannot be easily moved from one location to another after the dispenser has been opened without the containers falling out. It will be realized that the design of this carton is not satisfactory for dispensing bottles with necks as the exiting container being dispensed needs to have a corresponding cylindrical top and bottom of approximately the same size to facilitate easy dispensing by a person grasping the ends of the exiting container.

U.S. Pat. No. 4,364,509 to Holley, Jr. et al. also discloses a fully enclosed carton with a dispenser in one of the end walls. This dispenser is likewise formed in the end wall by tearing out an end flap and lowering it into proper position. Expansion slits are provided in the side wall for the user's fingers to grasp the ends of the exiting can. This carton is not adapted for use with bottles, because of the necessity of grasping the ends of the container for removal. In addition, it is not adapted for carrying cans once the carton has been opened as they are likely to roll out of the dispenser. There is also no safety net to receive the cans as they are rolled out of the dispenser.

SUMMARY OF THE INVENTION

It is an object of this invention to provide a dispenser that preserves the integrity of the carton after the dispenser has been opened. It is a further object to provide a dispenser that can be used with both cans and bottles. It is another object of this invention to provide a safety net or basket for the containers that are automatically dispensed when the dispenser is opened. It is a still further object of this invention is to develop a dispenser that will permit the carton to be moved from one location to another after it has been opened without discharging containers. The final object of this invention is to provide a dispenser that can be easily opened.

Briefly described, in a preferred form, the objects of this invention are achieved by providing an enclosed carton that has a unique dispenser in the exiting end of the carton. This carton is generally rectangular and has a bottom, a top, two sides, a closed end and an exiting end. The carton is foldably constructed from a blank having panels and flaps. The exiting end or ends of the carton permits containers to be taken from the carton via the dispenser.

This carton has a dispenser that is torn from an end of the carton by tearing an end portion of the top panel, a triangular portion from the adjoining side panels, and all of the side end flaps except the bottom most portions, to form a dispenser. The top end flap is removed when this dispenser is opened. This dispenser may have a semi-circular score line attached to the dispenser score line in the top panel for easy opening of the dispenser. A person's fingers can be inserted between this semi-circular score line and the dispenser to commence the opening of the dispenser. This semi-circular score line is placed so that when it is pushed open, a person's fingers will go between the first and second containers inside of the carton. A score line can be provided that bisects the semi-circular score line parallel to the longitudinal axis of the containers to permit ease of entry of a person's fingers. The bottom portions of the side end flaps are left intact to preserve the structural integrity of the carton and also to provide a wall to prevent an end container in the bottom of the carton from accidentally rolling out.

It should be realized that the dispenser does not have to be totally removed from the carton, as the score lines in the side and top panels can be broken and the dispenser flipped over along the score lines in the side end flaps to form a safety net or basket when the first container in the top of the carton rolls out of the dispenser. If the score line in the side end flaps is not broken, the dispenser can be reclosed.

This carton can be constructed by gluing, taping, stapling and the like, or by locking. The dispenser of this invention can be put in one end of the carton or in both ends. A dispenser can be torn from the carton and placed under the other end of the carton to elevate it to facilitate the removal of the containers from the carton. These and other objects, features, and advantages of the present invention will become more apparent upon reading the following specification in conjunction with the accompanying drawing figures.

DETAILED DESCRIPTION OF THE PREFERRED EMBODIMENTS

Figure 1:
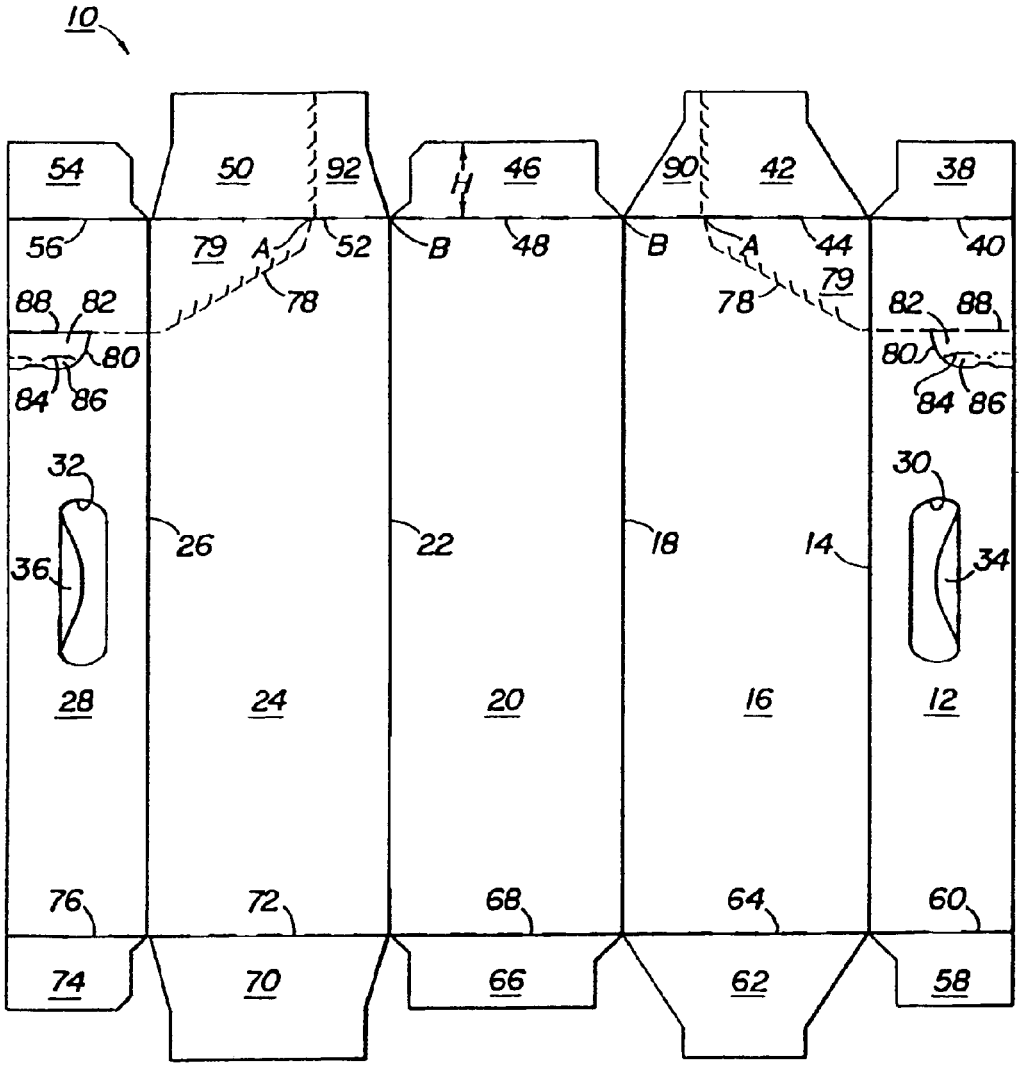
FIG. 1 is a plan view of a blank from which a carton according to this invention is formed.

The present invention is intended primarily for use with cans and bottles of the types used to contain soft drinks, beer and the like. The blank 10 is formed from a foldable sheet material, such as paperboard. The blank has a top flap 12 which is connected by fold line 14 to side panel 16, which in turn is connected by fold line 18 to bottom panel 20. Bottom panel 20 is connected by fold line 22 to side panel 24, which in turn is connected by fold line 26 to top flap 28.

This carton is capable of containing cans or bottles in two rows of six containers each. This carton has the "racetrack" handle 30 and 32 formed in the top flaps, 12 and 28, respectively. Cushioning flaps 34 and 36 are provided for the comfort of a person's hands, and are foldably joined to top flaps 12 and 28. On the exiting end of the carton, top end flap 38 is joined to top flap 12 by fold line 40. Side end flap 42 is joined to side panel 16 by fold line 44. Bottom end flap 46 is joined to bottom panel 20 by fold line 48. Side end flap 50 is joined by fold line 52 to side panel 24. Top end flap 54 is joined to top flap 28 by fold line 56.

On the closed end of the carton, top end flap 58 is connected to top flap 12 by fold line 60, side end flap 62 is connected to side panel 16 by fold line 64, bottom end flap 66 is attached to bottom panel 20 by fold line 68, side end flap 70 is connected to side panel 24 by fold line 72 and top end flap 74 is connected to top flap 28 by fold line 76.

It will be understood by those skilled in the art that the carton of the present invention is generally symmetrical about a horizontal line of bisection, as viewed when FIG. 1 is rotated lengthwise. This symmetry aids in the efficient production of the present carton.

In forming this blank 10 into a carton, top flap 12 is glued to top flap 28 forming a sleeve. The cans or bottles are then loaded into the carton on their sides and the various end flaps on both ends are closed. Using one end as an example, top end flaps 38 and 54 are folded downwardly and bottom end flap 46 is folded upwardly and then side end flaps 42 and 50 are folded sideways. These various end flaps are held together by glue or other means. The other end of the carton is glued and closed in the same fashion.

When the blank is folded and glued, the resulting carton has a closed end and an exiting end. However, a dispenser can be placed on both ends of the cartons. The containers exit the carton through the exiting end of the carton. The exiting end of the carton has a tear line 78 that extends through the top flaps 12 and 28, through the side panels 16 and 24 to form a triangular dispensing flap on the dispenser 79 into the side end flaps 42 and 50. In order to facilitate the opening of this dispenser 79, a finger flap 82 may be provided for the easy insertion of the fingers to start the tearing of the dispenser 79. Finger flap 82 is connected to top flaps 12 and 28 by tear line 80. Finger flap 82 may be provided with insertion flap 86 to facilitate entry of the fingers into the carton. For the opening of the dispenser 79, insertion flap 86 is connected to finger flap 82 by fold line 84. Finger flap 82 and insertion flap 86 are connected to the dispenser 79 by fold line 88 which interrupts the tear line 78. It will be noticed that tear line 78 extends into side end flaps 42 and 50 so as to form a substantial bottom portion 90 and 92 so that the end of the carton will have a bottom end when the dispenser 79 is opened.

Figure 2:
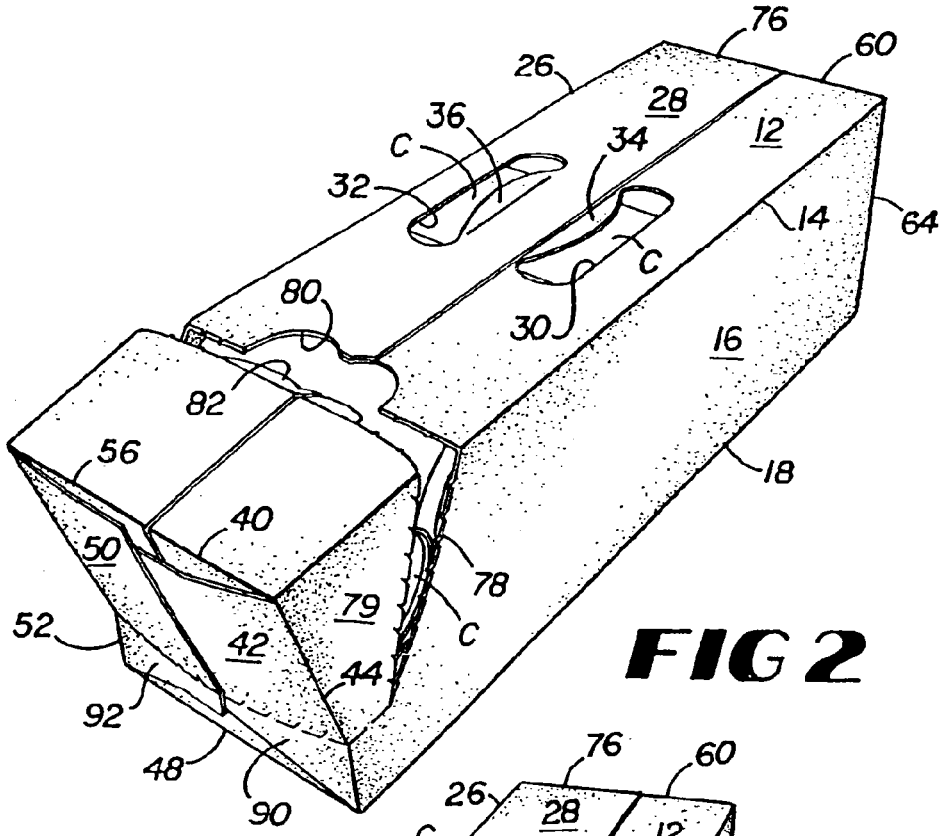
FIG. 2 is a perspective end view of the carton loaded with cans showing the dispenser being partially opened.

FIG. 2 shows the carton full of cans with the dispenser 79 open except for the tear lines 78 through the side end flaps 42, 50. It will be noted that the dispenser is a unitary structure. The dispenser 79 is opened by a person inserting his or her fingers into finger flap 82 and pulling the dispenser 79 open. Insertion flap 86 is provided to facilitate the entry of the fingers into the opening provided by finger flap 82. Finger flap 82 and insertion flap 86 are placed so that the fingers will enter the interior of the carton between the first and second cans.

Figure 3:
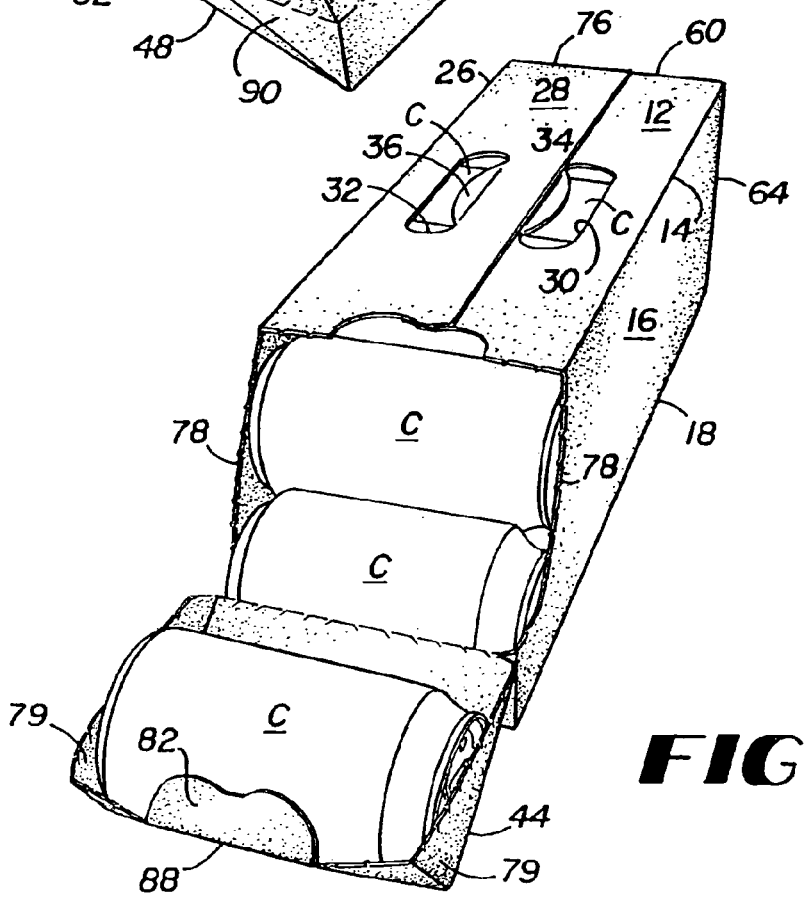
FIG. 3 is a perspective end view of the carton containing cans with the basket shaped dispenser open but attached and containing a can.

FIG. 3 shows the dispenser 79 completely opened but still attached to the carton by tear line 78 not being torn open through side end flaps 42 and 50. When the dispenser 79 is completely opened, the top can C will fall into the basket formed by the dispensing flap 79 and be retained. This dispenser 79 serves as a safety net to prevent the can from leaving the vicinity of the carton. The dispenser 79 forms a basket with triangular flaps forming side walls, side end flaps 42 and 50 forming a bottom wall and the torn off portions of the top flaps 12 and 28 forming an end wall.

In order to maintain the structural integrity of this carton, the bottom portions 90 and 92 of the side end flaps 42 and 50 are not removed from the carton when the dispenser is removed. The structural integrity of the carton is improved by the fact that the bottom end flap 46 is not removed. The bottom end flap 46 has a height H approximately equal to the distance between A and B along fold lines 44 and 52 respectively. This means that the bottom end flap 46 has the same height as the bottom portions 90 and 92 of the side end flaps 42 and 50, thus producing a strong bottom end structure.

If desired, the dispenser 79 can be totally removed from carton or left attached along tear line 78 in side flaps 42 and 50 and reclosed.

Figure 4:
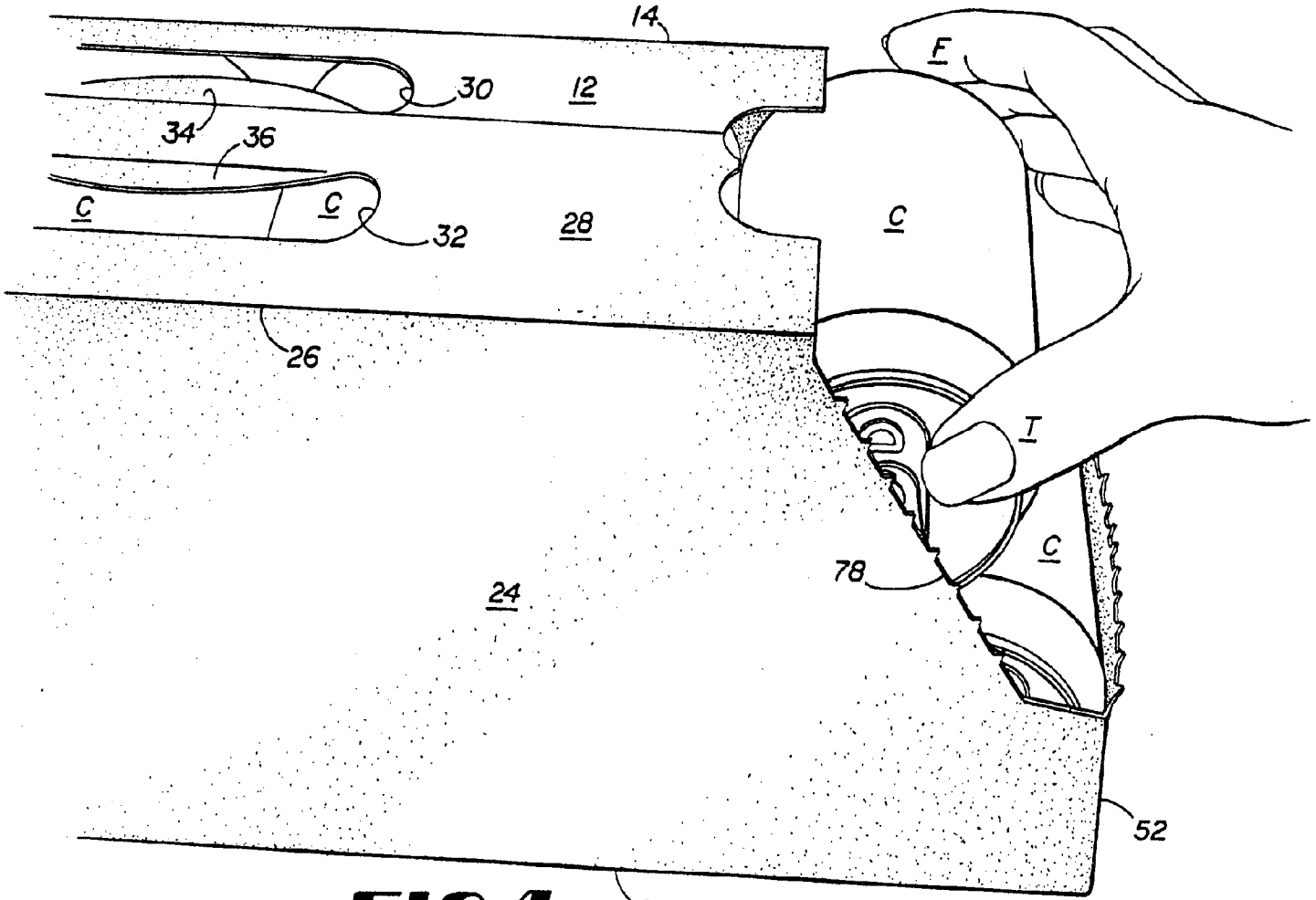
FIG. 4 is a perspective side view of the carton containing cans showing the top most end can being gripped by hand for removal from the carton.

As illustrated in FIG. 4, a can C can be easily removed from the carton by using the fingers F and the thumb T of a hand.

Figure 5:
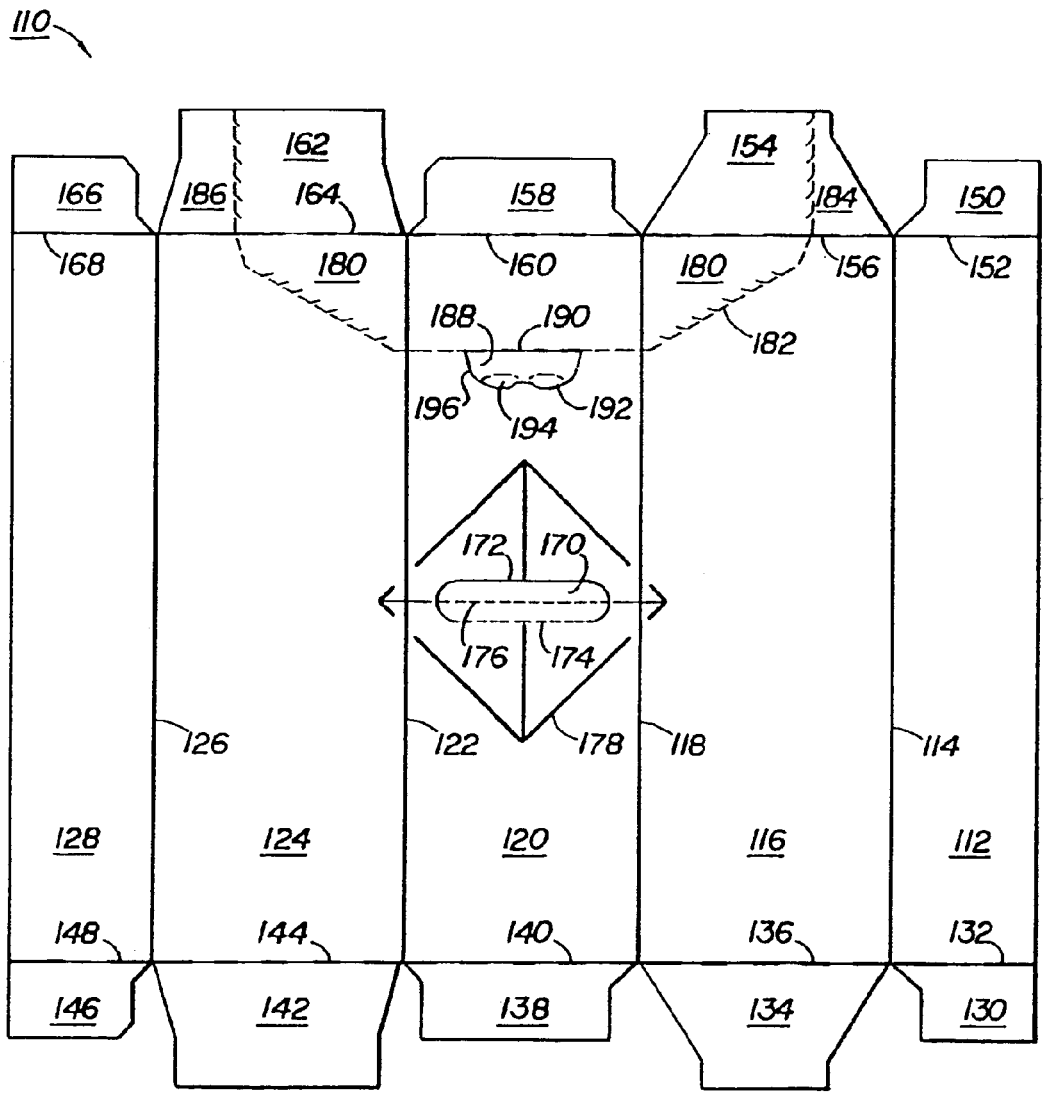
FIG. 5 is a plan view of the blank from which a carton according to this invention is formed having a single handle opening with the bottoms flaps being designed to be glued together.

FIG. 5 is a plan view of a blank from which a carton containing cans in three rows of four cans each according to the invention is formed. This carton has a single slot handle for carrying. The blank 110 has a bottom flap 112 which is connected by fold line 114 to side panel 116, which in turn is connected by fold line 118 to top panel 120. Top panel 120 in turn is connected by fold line 122 to side panel 124 which in turn is connected by fold line 126 to bottom flap 128. On the closed end of the carton, bottom end flap 130 is foldably connected by fold line 132 to bottom flap 112. Side end flap 134 is connected by fold line 136 to side panel 116. Top end flap 138 is connected by fold line 140 to top panel 120. Side end flap 142 is connected by fold line 144 to side panel 124 and bottom end flap 146 is connected by fold line 148 to bottom flap 128. The exiting end of the carton has a bottom end flap 150 which is connected to bottom flap 112 by fold line 152. Side end flap 154 is connected by fold line 156 to side panel 116. Top end flap 158 is connected by fold line 160 to top panel 120. Side end flap 162 is connected by fold line 164 to side panel 124. Bottom end flap 166 is connected by fold line 168 to bottom flap 128.

This carton has a slot handle 170 formed by cut line 172 and fold lines 174 and 176. It also has a score line 178 to assist in dissipating the forces involved in lifting a loaded carton.

A dispenser 180 is formed by tearing tear line 182 which extends from the top panel 120 through side panels 116, 124 and into side end flaps 154 and 162. Tear line 182 extends into side end flaps 154 and 162, so as to leave bottom portions 184, 186 that has a height when the carton is formed along lines 156, 164 respectively that is approximately equal to the height of bottom end flaps 150 and 166 in order to provide structural strength to the carton. This carton may have a finger flap 188 connected to dispenser 180 by fold line 190 and insertion flap 192 connected to finger flap 188 by fold line 194. Finger flap 188 and insertion flap 192 are joined to top panel 120 by tear line 196.

A sleeve from this carton is prepared by gluing the bottom flap 112 and 128 in an overlapping relationship. This carton is then loaded in the same manner as the carton shown in FIG. 2 through as the end of the cartons. Side end flaps 134, 142, 154, and 162 are glued over the bottom end flaps 130, 146, 150, 166 and top end flaps 138 and 158 to close the ends of the carton. The dispenser is opened in the same manner as the dispenser shown in FIGS. 1 and 2.

The dispenser of this invention can be used for both cans and other types of cylindrical containers. It is particularly useful for PET bottles having a stubby configuration.

UNIQUE FEATURES OF THE DISPENSER OF THIS INVENTION

One of the unique features of the dispenser of this invention is that it provides easy access to the cans or bottles in the carton but yet does not greatly diminish the structural integrity of the carton. This is partly because the bottom end of the end panel in which the dispenser is located is retained. This accomplished by leaving a bottom portion on the side end panel that is equal in height to the bottom end flaps.

The dispenser of this invention provides an easy opening feature in that it has a finger flap and insertion flap so that a person's fingers can be inserted between the first and second can to open the dispenser.

This dispenser also provides a safety net or basket in that if the tear line for the dispenser is not torn along the side end flaps, it remains attached to the carton and can catch in its basket a can as it is removed from the carton.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. An enclosed carton for a plurality of containers in two rows, with a top row and a bottom row, the carton comprising:

a. a top panel, side panels, a bottom panel, and two closed ends, at least one of which is an exiting end;

b. a dispenser adapted to be opened to form an opening at the exiting end through which the containers may be removed, and to catch one or more containers exiting the carton;

c. the dispenser being a unitary structure comprising a portion of the top panel, portions of the side panels, and a portion of the exiting end, said dispenser being detachable along a continuous, perforated line extending across the top panel, the side panels, and the exiting end; and d. means in the top panel for starting the opening of the dispenser.

2. The carton of claim 1, said dispenser adapted to be hingedly connected to the exiting end after said dispenser is opened.

3. The carton of claim 1, wherein the continuous line comprises a tear line.

4. The carton of claim 1, wherein the means for starting comprises a finger flap.

5. The carton of claim 4, in which the finger flap is positioned along the top panel above and between a first container and a second container in the top row adjacent the exiting end.

6. The carton of claim 1, wherein each end comprises a top end flap, a bottom end flap, and side end flaps, and includes means holding said flaps together.

7. The carton of claim 1, which comprises only two rows of the containers, with each said container in the top row being positioned directly above a corresponding container in the bottom row.

8. The carton of claim 7, wherein the rows include a first container and a second container adjacent to and contacting a first closed end and a third container and a fourth container adjacent to and contacting a second closed end.

9. The carton of claim 8, wherein the first and third containers are arranged in the top row of containers and the second and fourth containers are in the bottom row of containers.

10. An enclosed carton for a plurality of containers in two rows, with a top row and a bottom row, the carton comprising:

a. a top panel, side panels, a bottom panel, and closed ends, at least one of which is an exiting end;

b. a dispenser adapted to be opened and hingedly connected to said exiting end, said dispenser being detachable from the carton to form an opening at the exiting end through which the containers may be removed;

c. the dispenser being a unitary structure comprising a portion of the top panel, portions of the side panels, and a portion of the exiting end, said dispenser being removable along a continuous line extending across the top panel, the side panels, and the exiting end; and d. means in the top panel for facilitating detachment of the dispenser.

11. The carton of claim 10, wherein the continuous line comprises a tear line.

12. The carton of claim 10, wherein the means for facilitating comprises a finger flap.

13. The carton of claim 12, in which the finger flap is located between a first container and a second container in the top row.

14. The carton of claim 10, which comprises only two rows of the containers, with each said container in the top row being positioned directly above a corresponding container in the bottom row.

15. The carton of claim 14, wherein the rows include a first container and a second container adjacent to and contacting a first closed end and a third container and a fourth container adjacent to and contacting a second closed end.

16. The carton of claim 15, wherein the first and third containers are arranged in the upper row of containers and the second and fourth containers are in the lower row of containers.

17. A blank for forming an enclosed carton for a plurality of containers arranged in rows, with a top row and a bottom row, the blank comprising:

a. a sheet of material having parallel fold lines therein, the parallel fold lines defining areas of the sheet corresponding to a top, two sides and a bottom of the carton;

b. at one end of the parallel fold lines, a transverse fold line substantially perpendicular to the parallel fold lines, and a side end flap connected by the transverse fold line to each of the areas corresponding to the two sides;

c. a tear line extending across the areas corresponding to the top and the two sides and continuing to the transverse fold line, and then from the transverse fold line across each of the side end flaps;

d. means adjacent the tear line in the area corresponding to the top for facilitating the tearing of at least a portion of said tear line; and e. the tear line defining a unitary container dispenser and with the tear line being continuous across the side end flaps, the top and the two sides when the blank is formed into the enclosed carton.

18. The blank of claim 17, wherein the means for facilitating comprises a finger flap.

19. The blank of claim 18, wherein the finger flap is positioned to be located between a first container and a second container in the top row when the carton is assembled and the containers are arranged in rows.

20. The blank of claim 17, wherein a first side area comprises first and second parallel fold lines defining a first panel, a bottom area comprises the second parallel fold line and a third parallel fold line defining a second panel, an other side area comprises the third parallel fold line and a fourth parallel fold line defining a third panel, and a top area comprises two top flaps, one top flap being connected to the first panel at the first parallel fold line, and the other top flap being connected to the third panel at the fourth parallel fold line.

21. The blank of claim 20, wherein the tear line extends across each of the top flaps, such that when the carton is formed from the blank, a single tear line will be formed across the top of the carton.

22. The method of forming the blank of claim 20, into a carton, comprising the steps of:

a. attaching the top flaps together to form a sleeve;

b. loading the containers into the sleeve; and c. closing both ends of the sleeve.

23. The method of claim 22, wherein the containers are loaded into the sleeve on their sides, to form the top row and the bottom row, with each said container in the top row being positioned directly above a corresponding container in the bottom row.

24. The method of claim 23, wherein the rows include a first container and a second container adjacent to and contacting a first closed end and a third container and a fourth container adjacent to and contacting a second closed end.

25. The method of claim 24, wherein the first and third containers are in the top row and the second and fourth containers are in the bottom row.

26. The blank of claim 17, wherein a first side area comprises first and second parallel fold lines defining a first panel, a top area comprises the second parallel fold line and a third parallel fold line defining a second panel, an other side area comprises the third parallel fold line and a fourth parallel fold line defining a third panel, and a bottom area comprises two bottom flaps, one bottom flap being connected to the first panel at the first parallel fold line, and the other bottom flap being connected to the third panel at the fourth parallel fold line.

27. The method of forming the blank of claim 26, into a carton, comprising the steps of:

a. attaching the bottom flaps together to form a sleeve;

b. loading the containers into the sleeve; and c. closing both ends of the sleeve.

28. The method of claim 27, wherein the containers are loaded into the sleeve on their sides, to form the top row and the bottom row, with each said container in the top row being positioned directly above a corresponding container in the bottom row.

29. The method of claim 28, wherein the rows include a first container and a second container adjacent to and contacting a first closed end, and a third container and a fourth container adjacent to and contacting a second closed end.

30. The method of claim 29, wherein the first and third containers are arranged in the top row of containers and the second and fourth containers are in the bottom row of containers.

31. A blank for forming an enclosed carton for a plurality of containers in two rows, with a top row and a bottom row, the blank comprising:

a. a first top flap connected to one edge of a first side panel by a first fold line, a bottom panel connected at one edge to the opposite edge of the first side panel by a second fold line, a second side panel connected at one edge to the opposite edge of the bottom panel by a third fold line, and a second top flap connected to the opposite edge of the second side panel by a fourth fold line;

b. a first side end flap having a free end and being joined to one end of the first side panel by a fifth fold line, and a second side end flap joined to the corresponding end of the second side panel by a sixth fold line;

c. a tear line in the first top flap extending to the first fold line, across the first side panel to the first point on the fifth fold line, and then across the first side end flap from the first point to the free end of the first side end flap;

d. a tear line in the second top flap extending to the fourth fold line, across the second side panel to a second point on the sixth fold line, then across the second side end flap from the second point to the free end of the second side end flap;

e. means in the first and second top flaps for facilitating the tearing of at least a portion of the tear lines in those flaps; and f. the tear lines defining a unitary container dispenser when the enclosed carton is formed from the blank, with the portions of the tear lines adjacent the free ends of the side end flaps forming a continuous tear line across the side end flaps.

32. The blank of claim 31, wherein the tear line extending across the first side panel extends at least partially diagonally toward the first side end flap, and the tear line extending across the second side panel extends at least partially diagonally toward the second side end flap, so that the tear lines define substantially triangular sections in both the first side panel and in the second side panel, respectively.

33. The blank of claim 31, wherein the means for facilitating comprises a finger flap.

34. The blank of claim 33, wherein the finger flap is between a first container and a second container in the top row when the carton is assembled and the containers are arranged in rows.

35. The blank of claim 31, including a bottom end flap joined to the corresponding end of the bottom panel adjacent the first and second side end flaps by a seventh fold line.

36. The blank of claim 35, including top end flaps joined to each end of each of the first and second top flaps by fold lines, a first side panel end flap joined to the end of the first side panel by a first side panel fold line, a second side panel end flap joined to the end of the second side panel by a second side panel fold line, and a bottom end flap joined to the end of the bottom panel by a bottom panel fold line.

37. The method of forming the blank of claim 36 into a carton, comprising the steps of:

a. attaching the first and second top flaps together to form a sleeve;

b. loading the containers into the sleeve; and c. attaching together the top end flaps, the first side panel end flap, the second side panel end flap, and the bottom end flap at each end of the sleeve.

38. The method of claim 37, wherein the containers are loaded into the sleeve on their sides to form the top row and the bottom row, with each said container in the top row being positioned directly above a corresponding container in the bottom row.

39. The method of claim 38, wherein the rows of containers include a first container and a second container adjacent to and contacting a first closed end and a third container and a fourth container adjacent to and contacting a second closed end.

40. The method of claim 39, wherein the first and third containers are arranged in the top row of containers and the second and fourth containers are in the bottom row of containers.

41. A blank for forming an enclosed carton for a plurality of containers arranged in rows, with a top row and a bottom row, the blank comprising:

a. a first bottom flap connected to one edge of a first side panel by a first fold line, a top panel connected at one edge to the opposite edge of the first side panel by a second fold line, a second side panel connected at one edge to the opposite edge of the top panel by a third fold line, and a second bottom flap connected to the opposite edge of the second side panel by a fourth fold line;

b. a first side end flap having a free end and being connected to an end of the first side panel by a fifth fold line, and a second side end flap having a free end and being connected to the corresponding end of the second side panel by a sixth fold line;

c. a first bottom end flap connected to the corresponding end of the first bottom flap adjacent the first side end flap by a seventh fold line, and a second bottom end flap connected to the corresponding end of the second bottom flap adjacent the second side end flap by an eighth fold line;

d. a tear line extending across the top panel between the second and third fold lines, across the first side panel from the second fold line to a first point on the fifth fold line, across the second side panel from the third fold line to a second point on the sixth fold line, across the first side end flap from the first point to the free end of the first side end flap, and across the second side end flap from the second point to the free end of the second side end flap;

e. the tear line defining a unitary container dispenser when the enclosed carton is formed from the blank, with the portions of the tear line adjacent the free ends of the first and the second side end flaps forming a single tear line across the side end flaps and the portions of the tear lines across the first and second side end flaps forming a hinge line for the dispenser.

42. The blank of claim 41, wherein the tear line extends at least partially diagonally across the first side panel toward the first side end flap, and the tear line extending across the second side panel extends at least partially diagonally toward the second side end flap, so that the tear line defines a substantially triangular section in both the first side panel and in the second side panel.

43. The blank of claim 41, wherein a substantial portion of the tear line across the first side panel and across the second side panel extends diagonally from a point adjacent said top panel to a point adjacent the first side end flap and the second side end flap, respectively.

44. The blank of claim 41, and means defined in the top panel for facilitating the detachment of the dispenser.

45. The blank of claim 44, wherein the means for facilitating comprises a finger flap.

46. The blank of claim 45, wherein the finger flap is between a first container and a second container in the top row when the carton is assembled and the containers are arranged in rows.

47. The blank of claim 41, including top end flaps joined to each end of the top panel by fold lines, a first side panel end flap joined to the end of the first side panel by a first side panel fold line, a second side panel end flap joined to the end of the second side panel by a second side panel fold line, and bottom end flaps joined to the ends of the first and second bottom flaps by bottom panel fold lines.

48. The method of forming the blank of claim 47 into a carton, comprising the steps of:

a. attaching the bottom flaps together to form a sleeve;

b. loading the containers into the sleeve; and c. closing both ends of the sleeve.

49. The method of claim 48, wherein the containers are loaded into the sleeve on their sides in the top row and in the bottom row, with each said container in the top row positioned directly above a corresponding container in the bottom row.

50. The method of claim 49, wherein the rows of containers include a first container and a second container adjacent to and contacting a first closed end and a third container and a fourth container adjacent to and contacting a second closed end.

51. The method of claim 50, wherein the first and third containers are in the top row of containers and the second and fourth containers are in the bottom row of containers.

52. A method of opening an enclosed carton containing a plurality of containers in rows, including at least a top row and a bottom row, the carton having (i) a top panel, side panels, a bottom panel, and closed ends, at least one of which is an exiting end, and (ii) a dispenser which is a unitary structure comprising a portion of the top panel, portions of the side panels, and the upper portion of the exiting end, said dispenser being defined by a tear line extending across the top panel, the side panels, and the exiting end, the carton including means for facilitating opening of the dispenser located at the portion of the tear line which extends across the top panel, the method comprising the steps of:

a. tearing a portion of the tear line extending across the top panel; and b. opening the dispenser in a direction away from the containers so that the portions of the tear line that extend across the top panel and the side panels are torn to allow the dispenser to remain attached and form a basket at the exiting end of the carton.

53. The method of claim 52, including the step of continuing the opening of the dispenser until the portion of the tear line extending across the exiting end is completely detached from the carton.

54. An enclosed carton for a plurality of containers in two rows, with a top row and a bottom row, the carton comprising:

a. a top panel, side panels, a bottom panel, and closed ends, at least one of which is an exiting end;

b. a dispenser which is detachable from the carton to form an opening at the exiting end through which the containers may be removed;

c. the dispenser being a unitary structure comprising a portion of the top panel, portions of the side panels, and a portion of the exiting end, said dispenser being defined by a perforated line comprising a tear line extending across the top panel, the side panels, and the exiting end; and d. wherein a portion of said line extending across said exiting end forms a hinge line that allows the dispenser to be pivoted to an open position and form a basket at the exiting end of the carton.

55. The carton of claim 54, including means in the top panel for facilitating the opening of the dispenser, whereby opening of the dispenser is started at the top panel.

56. The carton of claim 55, the means for facilitating comprising a finger flap positioned in said top panel approximately between a first container and second container in the top row.

57. The carton of claim 55, which is so dimensioned as to carry only two rows of containers, with each said container in the top row being positioned directly above a corresponding container in the bottom row, whereby the basket will catch an end container in the top row when the dispenser is opened.

58. The carton of claim 57, wherein the rows of containers include a first container and a second container adjacent to and contacting a first closed end and a third container and a fourth container adjacent to and contacting a second closed end.

59. The carton of claim 58, wherein the first and third containers are arranged in the top row of containers and the second and fourth containers are in the bottom row of containers.

60. An enclosed carton for carrying a plurality of containers in only two rows, with a top row and a bottom row, the carton comprising:

a. a top panel, side panels, a bottom panel, and closed ends, at least one of which is an exiting end, each container in the top row positioned directly above and parallel to a corresponding container in the bottom row;

b. a dispenser that is detachable from the carton to form an opening at an exiting end through which the containers may be removed; and c. the dispenser being a unitary structure comprising a portion of the top panel, portions of the side panels, and a portion of the exiting end, said dispenser being defined by a tear line extending across the top panel, the side panels, and the exiting end, and wherein the dispenser is capable of remaining attached to the carton to form a basket at the exiting end of the carton.

61. The carton of claim 60, wherein the dispenser is capable of remaining attached to the carton by a portion of the tear line which extends across the exiting end.

62. The carton of claim 60, including means in the top panel for facilitating the opening of the dispenser, whereby opening of the dispenser is started at the top panel.

63. The carton of claim 60, wherein the rows of containers include a first container and a second container adjacent to and contacting a first closed end and a third container and a fourth container adjacent to and contacting a second closed end.

64. The carton of claim 63, wherein the first and third containers are arranged in the top row of containers and the second and fourth containers are in the bottom row of containers.

65. The carton of claim 62, the means for facilitating comprising a finger flap located along the tear line extending across the top panel for opening the dispenser along the line.

66. A blank for forming an enclosed carton for a plurality of containers arranged in two rows, with a top row and a bottom row, the blank comprising:

a. a sheet of material having first, second, third and fourth parallel fold lines therein, said parallel fold lines defining areas of the sheet corresponding to a top, two sides and a bottom of the carton;

b. at one end of the parallel fold lines, a transverse fold line substantially perpendicular to the parallel fold lines, and a side end flap connected by the transverse fold line to each of the areas corresponding to the two sides;

c. a line of removal extending across the areas corresponding to the top and then across the two sides in a substantially diagonal path from the top to the transverse fold line, and then from the transverse fold line across each of the side end flaps to their free ends; and d. the line of removal defining a unitary container dispenser when the enclosed carton is formed from the blank, with the portions of the line of removal adjacent the free ends of the side end flaps being so located that a substantially continuous line of removal will be formed across the side end flaps, the top and the two sides of the carton.

67. The blank of claim 66, wherein the area corresponding to one side comprises a first panel located between the first and second parallel fold lines, the area corresponding to the bottom comprises a second panel located between the second and third parallel fold lines, the area corresponding to the other side comprises a third panel located between the third and fourth parallel fold lines, and the area corresponding to the top comprises two top flaps, one of which is connected to the first panel at the first parallel fold line, and the other of which is connected to the third panel at the fourth parallel fold line.

68. The blank of claim 67, wherein the line of removal extends across each of the top flaps, such that when the carton is formed from the blank, a single line of removal will be formed across the top of the carton.

69. The method of forming the blank of claim 67 into a carton, comprising the steps of:

a. attaching the top flaps together to form a sleeve;

b. loading the containers into the sleeve; and c. closing both ends of the sleeve.

70. The method of claim 69, wherein the containers are loaded into the sleeve on their sides, to form the top row and the bottom row, with each said container in the top row being positioned directly above a corresponding container in the bottom row.

71. The method of claim 70, wherein the rows of containers include a first container and a second container adjacent to and contacting a first closed end and a third container and a fourth container adjacent to and contacting a second closed end.

72. The method of claim 71, wherein the first and third containers are arranged in the top row of containers and the second and fourth containers are in the bottom row of containers.

73. A blank for forming an enclosed carton for a plurality of containers in two rows, with a top row and a bottom row, the blank comprising:

a. a first top flap connected to one edge of a first side panel by a first fold line, a bottom panel connected at one edge to the opposite edge of the first side panel by a second fold line, a second side panel connected at one edge to the opposite edge of the bottom panel by a third fold line, and a second top flap connected to the opposite edge of the second side panel by a fourth fold line;

b. a first side end flap joined to one end of the first side panel by a fifth fold line, and a second side end flap joined to the corresponding end of the second side panel by a sixth fold line;

c. a tear line in the first top flap extending to the first fold line, across the first side panel to a first point on the fifth fold line, and then across the first side end flap from the first point to a free end of the first side end flap;

d. a tear line in the second top flap extending to the fourth fold line, across the second side panel to a second point on the sixth fold line, then across the second side end flap from the second point to a free end of the second side end flap; and e. the tear lines defining a unitary container dispenser when the enclosed carton is formed from the blank, with the portions of the tear lines adjacent the free ends of the side end flaps being so located that a single tear line will be formed across the side end flaps.

74. The blank of claim 73, and further comprising a finger flap in the first and second top flaps adjacent the portions of the tear lines which extend across the first and the second top flaps.

75. The method of forming the blank of claim 73 into a carton, wherein the blank has a bottom end flap foldably attached to each end of the bottom panel, comprising the steps of:

a. attaching the first and second top flaps together to form a sleeve;

b. loading the containers into the sleeve; and c. attaching together the top end flaps, side end flaps and bottom end flap at each end of the sleeve.

76. The method of claim 75, wherein the containers are loaded into the sleeve on their sides, to form the top row and the bottom row, with each said container in the top row being positioned directly above a corresponding container in the bottom row.

77. The method of claim 76, wherein the rows of containers include a first container and a second container adjacent to and contacting a first closed end and a third container and a fourth container adjacent to and contacting a second closed end.

78. The method of claim 77, wherein the first and third containers are arranged in the top row of containers and the second and fourth containers are in the bottom row of containers.

79. A blank for forming an enclosed carton for a plurality of containers in two rows, with a top row and a bottom row, the blank comprising:

a. a first bottom flap connected to one edge of a first side panel by a first fold line, a top panel connected at one edge to the opposite edge of the first side panel by a second fold line, a second side panel connected at one edge to the opposite edge of the top panel by a third fold line, and a second bottom flap connected to the opposite edge of the second side panel by a fourth fold line;

b. a first side end flap joined to one end of the first side panel by a fifth fold line, and a second side end flap joined to the corresponding end of the second side panel by a sixth fold line;

c. a tear line extending across the top panel from the third fold line to the second fold line, across the first side panel to a first point on the fifth fold line, and then across the first side end flap from the first point to a free end of the first side end flap;

d. the tear line further extending from the third fold line, across the second side panel to a second point on the sixth fold line, then across the second side end flap from the second point to a free end of the second side end flap; and e. the tear line defining a unitary container dispenser when the enclosed carton is formed from the blank.

80. The blank of claim 79, and further comprising a finger flap in the top panel adjacent the portion of the tear line that extends across the top panel.

81. The method of forming the blank of claim 79 into a carton, comprising the steps of:

a. attaching the first and second bottom flaps together to form a sleeve;

b. loading the containers into the sleeve; and c. attaching together bottom end flaps, which are foldably attached to the ends of the first and second bottom flaps, the side end flaps and the top end flap at each end of the sleeve.

82. The method of claim 81, wherein the containers are loaded into the sleeve on their sides, to form the top row and the bottom row, with each said container in the top row being positioned directly above a corresponding container in the bottom row.

83. The method of claim 82, wherein the rows of containers include a first container and a second container adjacent to and contacting a first closed end and a third container and a fourth container adjacent to and contacting a second closed end.

84. The method of claim 83, wherein the first and third containers are arranged in the top row of containers and the second and fourth containers are in the bottom row of containers.

85. A method of opening an enclosed carton containing a plurality of containers in two rows, including a top row and a bottom row, the carton having (i) a top panel, side panels, a bottom panel, and closed ends, at least one of which is an exiting end, and (ii) a dispenser which is a unitary structure comprising a portion of the top panel, portions of the side panels, an upper portion of the exiting end, said portions being defined by a substantially continuous tear line extending across the top panel, the side panels, and the exiting end, the method comprising the steps of:

a. engaging a portion of the tear line extending along the top panel of the carton; and b. separating the dispenser from the carton along the tear line across the top panel and the side panels, the dispenser remaining attached to the carton at the exiting end thereby forming a basket at the exiting end of the carton.

86. The method of claim 85, including the step of subsequently removing the dispenser from the carton by detaching the portion of the tear line extending across the exiting end.

87. An enclosed carton for a plurality of containers in only two rows, including a top row and a bottom row, the carton comprising:

a top panel, two side panels, at least one bottom panel, and two closed ends, including an exiting end; wherein the top panel, the two side panels, and the at least one bottom panel are separated by parallel fold lines;

transverse fold lines at each said closed end; wherein the transverse fold lines define end flaps for the top panel, the two side panels, and the at least one bottom panel;

a continuous tear line formed at the exiting end in the top panel and continuing through each said side panel flap to define an opening section, said opening section being adapted to be hinged to said carton;

wherein the top row includes a top end container and the bottom row includes a bottom end container and wherein the top end container and the bottom end container contact the exiting end of the enclosed carton.

88. An enclosed carton for a plurality of containers in only two rows, including a top row and a bottom row, the carton comprising:

a top panel, two side panels, at least one bottom panel, and two closed ends, including an exiting end; wherein the top panel, the two side panels, and the at least one bottom panel are separated by parallel fold lines;

transverse fold lines at each said closed end; wherein the transverse fold lines define end flaps for the top panel, the two side panels, and the at least one bottom panel;

a continuous tear line defining an opening section that forms a dispensing opening along the top panel of the exiting end to allow access to the containers in the enclosed carton, said opening section being adapted to be hinged to said carton;

wherein the top row includes a top end container and the bottom row includes a bottom end container and wherein the top end container and the bottom end container contact the exiting end of the enclosed carton.

89. An enclosed carton for a plurality of containers in only two rows, including a top row and a bottom row, the carton comprising:

a top panel, two side panels, at least one bottom panel, and two closed ends, including an exiting end; wherein the top panel, the two side panels, and the at least one bottom panel are separated by parallel fold lines, including two top panel parallel fold lines that separate the top panel from each said side panel;

transverse fold lines spaced from each said closed end; wherein the transverse fold lines define end flaps for the top panel, the two side panels, and the at least one bottom panel;

a continuous tear line formed at the exiting end and proceeding through the top panel, through each said side panel, and through each said side panel flap to define a dispenser at the exiting end for dispensing one or more containers;

wherein the continuous tear line, each said top panel parallel fold line, and the transverse fold line at the exiting end form substantially triangular shaped areas in each said side panel.

90. A blank for forming an enclosed carton for a plurality of containers in only two rows, the carton comprising:

a top panel, two side panels, at least one bottom panel and two closed ends, including an exiting end; wherein the top panel, the side panels, and the at least one bottom panel are separated by parallel fold lines;

transverse fold lines spaced from each said closed end; wherein the transverse fold lines define end flaps for the top panel, the side panels, and the at least one bottom panel;

a tear line that extends through the top panel and the side panels to define a dispenser at the exiting end and for dispensing one or more containers;

wherein the tear line comprises a continuous line of perforations that proceeds through each said side panel in a generally diagonal direction from the top panel toward and into each said side panel end flap.

* * * * *